US010063016B2

(12) United States Patent
Ito et al.

(10) Patent No.: US 10,063,016 B2
(45) Date of Patent: Aug. 28, 2018

(54) FUSE PROTECTED SOCKET HAVING ADDITIONAL ATTACHMENT POINTS

(71) Applicants: Kubota Corporation, Osaka-shi (JP); DDK Ltd., Tokyo (JP)

(72) Inventors: Hirokazu Ito, Sakai (JP); Kazuo Koike, Sakai (JP); Masatake Takai, Tokyo (JP); Koichi Yokota, Tokyo (JP); Kazuyuki Ozai, Tokyo (JP)

(73) Assignees: Kubota Corporation, Osaka (JP); DDK Ltd., Tokyo (JP)

( * ) Notice: Subject to any disclaimer, the term of this patent is extended or adjusted under 35 U.S.C. 154(b) by 0 days.

(21) Appl. No.: 15/178,877

(22) Filed: Jun. 10, 2016

(65) Prior Publication Data

US 2017/0070011 A1 Mar. 9, 2017

(30) Foreign Application Priority Data

Sep. 7, 2015 (JP) ..... 2015-176014

(51) Int. Cl.

*H01R 13/684* (2011.01)
*H01R 13/68* (2011.01)
*H01R 13/696* (2011.01)

(52) U.S. Cl.

CPC ..... *H01R 13/684* (2013.01); *H01R 13/68* (2013.01); *H01R 13/696* (2013.01)

(58) Field of Classification Search

CPC .... H01H 13/68; H01H 13/684; H01H 13/688; H01H 13/696

USPC ..... 439/620.26, 620.28, 620.31, 620.34

See application file for complete search history.

(56) References Cited

U.S. PATENT DOCUMENTS 5,593,323 A * 1/1997 Dernehl ..... H01R 13/717 439/638
9,806,470 B2 * 10/2017 Okamoto ..... H01R 13/68

FOREIGN PATENT DOCUMENTS

JP 2012182106 A 9/2012
JP 201582405 A 4/2015

* cited by examiner

*Primary Examiner* — Vanessa Girardi
(74) *Attorney, Agent, or Firm* — The Webb Law Firm

(57) ABSTRACT

An electric connector includes a socket connector, a bar-like plug connector to be inserted/withdrawn to/from the socket connector and a fuse. When the plug connector is inserted to the socket connector, electric conduction is established in the electric circuit via the fuse. The fuse is attached to the socket connector.

13 Claims, 7 Drawing Sheets

FUSE PROTECTED SOCKET HAVING ADDITIONAL ATTACHMENT POINTS

CROSS-REFERENCE TO RELATED APPLICATION

This application claims priority to Japanese Patent Application No. 2015-176014 filed Sep. 7, 2015, the disclosure of which is hereby incorporated in its entirety by reference.

FIELD OF THE INVENTION

The present invention relates to an electric connector having a plug connector to be inserted/withdrawn to/from a socket connector.

DESCRIPTION OF RELATED ART

In an electric vehicle, a hybrid vehicle or the like, there is provided an electric connector for maintenance (so-called "a service plug"). Normally, a plug connector is inserted in a receptacle connector. And, in such vehicle, when a maintenance of its electric system is to be carried out, the plug connector is withdrawn from the receptacle connector, so that electric current from a battery can be shut off. As such electric connector, an electric connector disclosed in Patent Document 1 is known for example. This electric connector includes a plug connector having a plug contact accommodated in a rectangular-shaped plug housing and a receptacle connector having a receptacle contact accommodated in a rectangular-shaped receptacle housing. In the plug housing, a fuse is also provided.

Further, as an electric connector realizing compactization of the above-described electric connector, an electric connector disclosed in Patent Document 2 is known also for example. This electric connector includes a bar-shaped plug connector and a socket connector (receptacle connector). The plug connector of this electric connector does not have such rectangular-shaped housing as provided in the electric connector disclosed in Patent Document 1. Therefore, this is to realize compactization, as compared with the electric connector disclosed in Patent Document 1.

BACKGROUND ART DOCUMENTS

Patent Documents

[Patent Document 1] Japanese Unexamined Patent Application Publication No. 2012-182106

[Patent Document 2] Japanese Unexamined Patent Application Publication No. 2015-82405

SUMMARY OF THE INVENTION

Problem to be Solved by Invention

With the electric connector disclosed in Patent Document 1, since the plug connector includes a housing that accommodates a fuse, further compactization is difficult. On the other hand, with the electric connector disclosed in Patent Document 2, the plug connector has a bar-like form, which makes it difficult to provide a fuse therein. So, no fuse is provided. For this reason, when it is necessary to incorporate a fuse in an electric circuit, a member such as a conductive wire, a terminal member, and holder for holding a fuse is required. Thus, a large space will be required for the device as a whole, so additional cost too will be required.

In view of the above-described state of the art, there is a need for an electric connector that allows compactization of the device as a whole and that allows also reduction in the number of components and costs of the device as a whole.

Solution

An electric connector according to the present invention is an electric connector to be incorporated in an electric circuit, the electric connector comprising:

a socket connector;

a bar-like plug connector to be inserted/withdrawn to/from the socket connector; and a fuse;

wherein when the plug connector is inserted to the socket connector, electric conduction is established in the electric circuit via the fuse; and the fuse is attached to the socket connector.

With this characterizing feature, by causing the socket connector to function as a fuse holder for holding the fuse, the fuse can be provided integrally with the socket connector, so there is no need to provide a fuse holder, a conductive wire for the fuse, etc. additionally. Therefore, compactization of the device is possible together with reduction of the number of components and reduction of cost.

Further, in the present invention, preferably, the socket connector includes a positive electrode portion and a negative electrode portion that can be electrically conducted with the plug connector; and the positive electrode portion is disposed on a far side in an inserting direction of the plug connector, and the negative electrode portion is disposed on a near side in the inserting direction.

With the above arrangement, when the plug connector is withdrawn from the socket connector, since the positive electrode portion is disposed on the far side, even before complete withdrawal of the plug connector from the socket connector, contact between the plug connector and the positive electrode portion is released upon withdrawal of the plug connector by a certain degree. In this way, by shutting off the electric conduction between the plug connector and the positive electrode portion at an early stage in the withdrawal operation of the plug connector, there is realized a situation of no electric potential being impinged from the positive electrode portion to the plug connector, so that the withdrawal operation of the plug connector from the socket connector can be carried out in a reliable manner.

Further, in the present invention, preferably, when the fuse is attached to the socket connector, a longitudinal direction of the fuse is aligned with the inserting/withdrawing direction of the plug socket.

With the above arrangement, by aligning the longitudinal direction of the fuse with the inserting/withdrawing direction of the plug socket, the fuse is to be attached to the socket connector along the longitudinal direction of the socket connector. As a result, further compactization of the electric connector is made possible.

Further, in the present invention, preferably, the fuse includes a pair of terminal portions to be attached to the socket connector; and the socket connector includes a pair of attaching portions to which the pair of terminal portions are to be attached.

With this arrangement, the fuse is supported to the socket connector at two portions, thus rendering the attached condition reliable and sturdy.

Further, in the present invention, preferably, the socket connector includes a plurality of the attaching portions provided side by side and greater in number than the pair of terminal portions.

With the above arrangement, according to which two of the plurality of attaching portions are selected, fuses having different attaching pitches can be attached. For instance, in case three attaching portions are provided side by side, a fuse having a short attaching pitch will be attached to two adjacent attaching portions of the three attaching portions. Or, a fuse having a long attaching pitch will be attached to two attaching portions on the opposed ends of the three attaching portions.

Further, in the present invention, preferably, a spacing between the pair of attaching portions is changeable.

With this arrangement, by changing the spacing between the pair of attaching portions, fuses having different sizes can be attached.

Further, in the present invention, preferably, the socket connector defines a receded portion and the fuse is attached to the socket connector with the fuse being placed within the receded portion.

With this arrangement, it is possible to minimize the thickness of the fuse and the socket connector combined together, thus realizing compactization of the electric connector as a whole including the fuse.

DESCRIPTION OF THE INVENTION

Embodiments of the present invention will be explained with reference to the drawings.

[General Configuration of Electric Connector]

Figure 1:
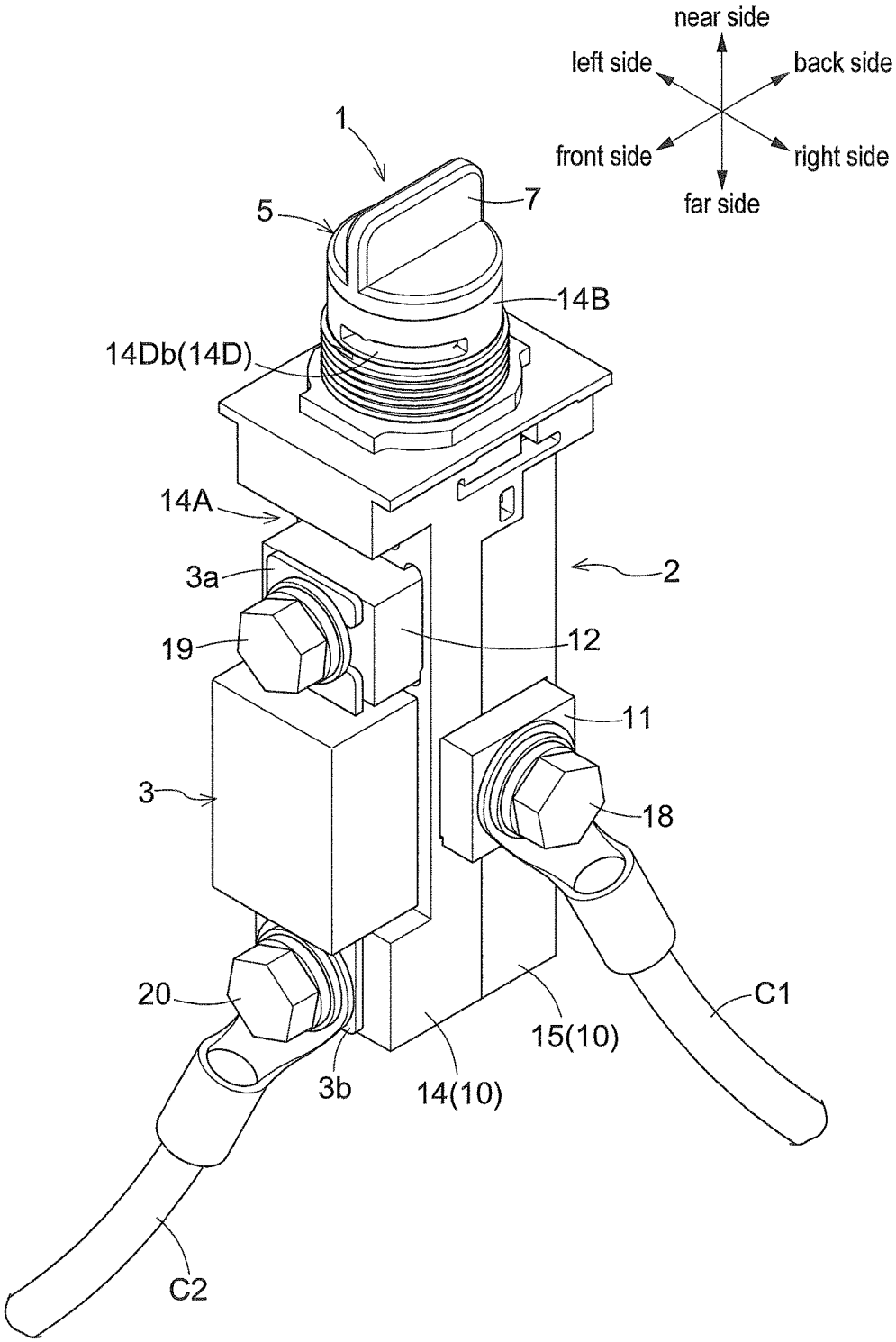
FIG. 1 is a perspective view showing an electric connector.
Figure 2:
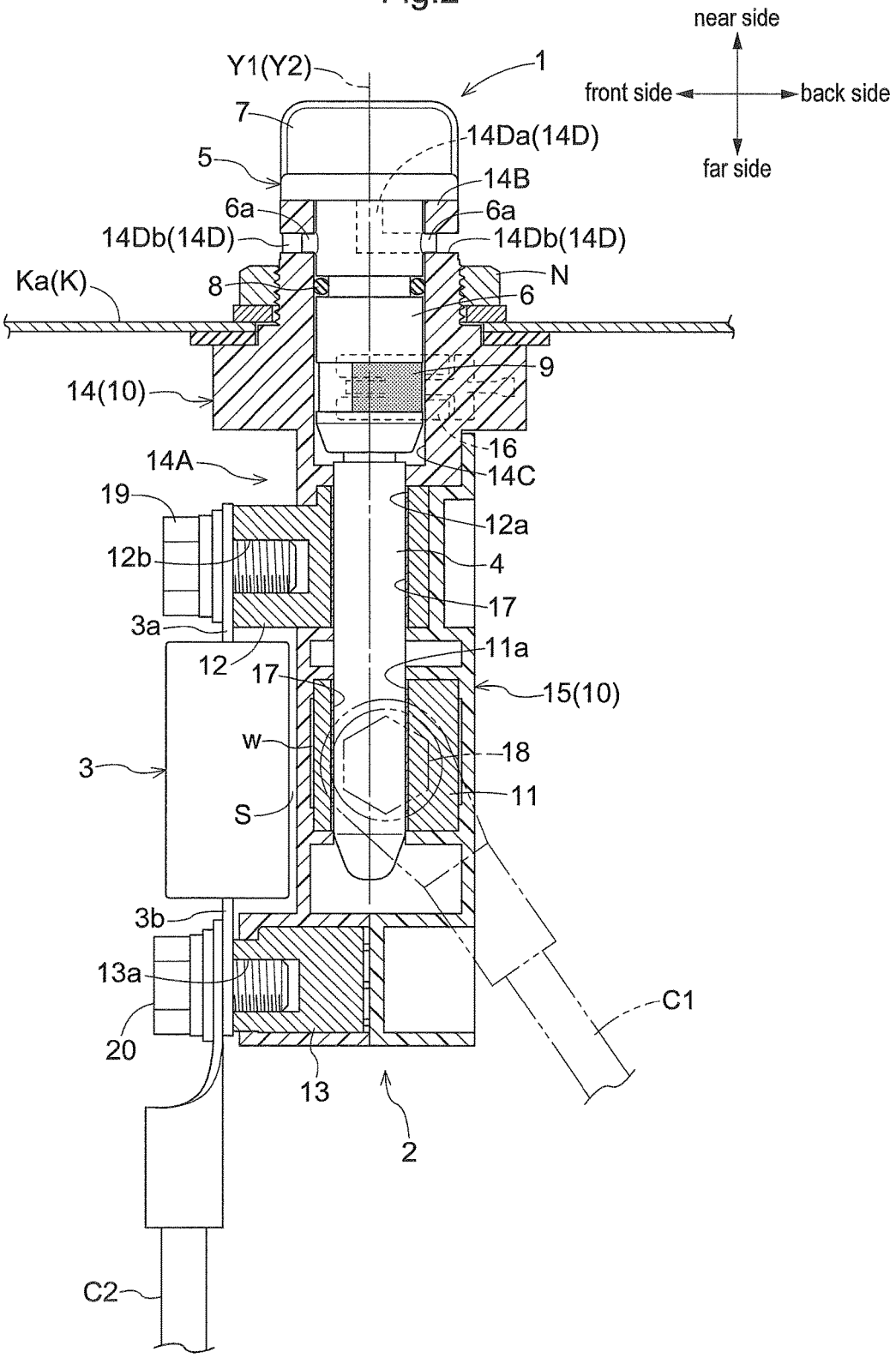
FIG. 2 is a vertical section showing the electric connector.
Figure 3:
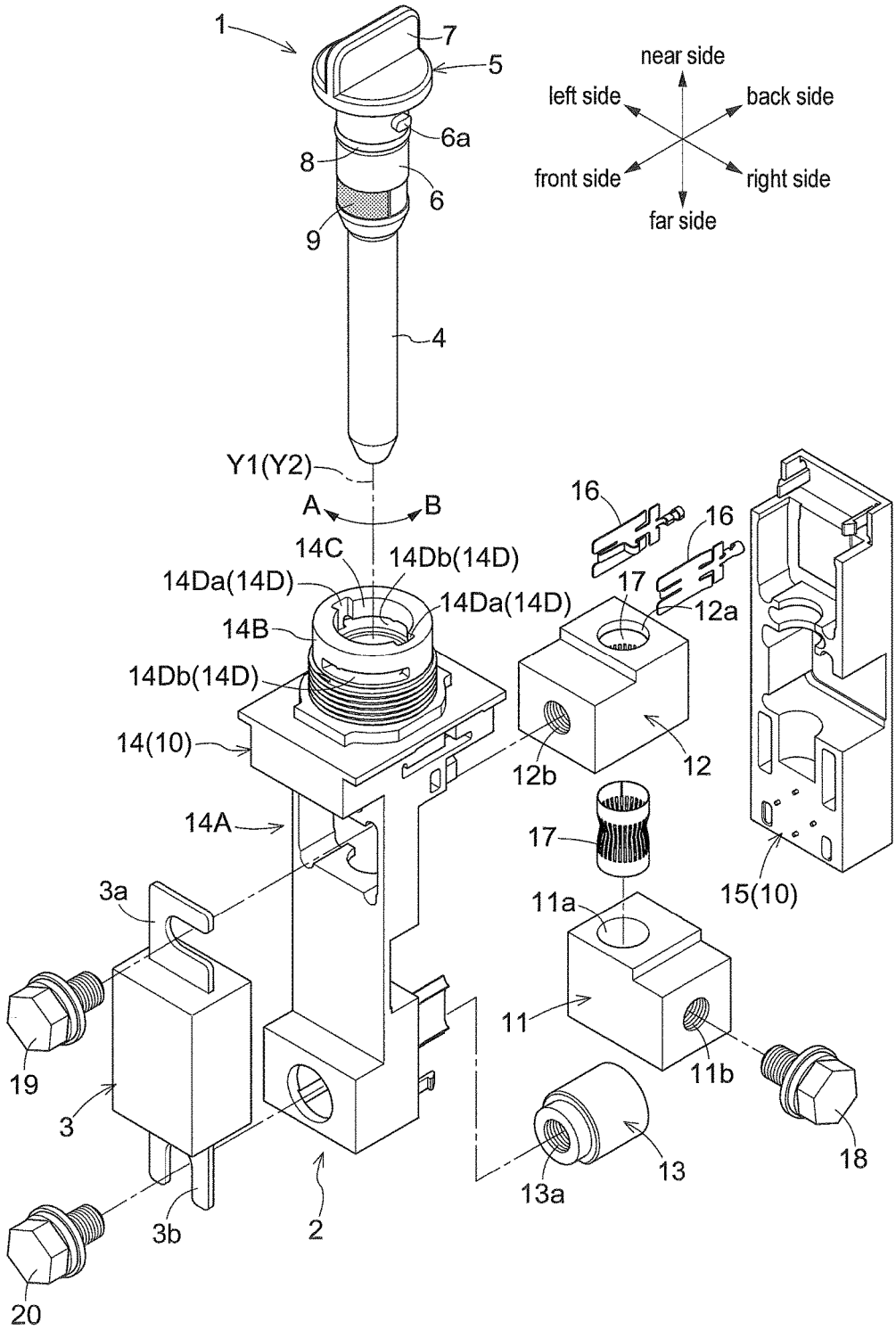
FIG. 3 is an exploded perspective view showing the electric connector.

As shown in FIGS. 1 through 3, an electric connector is an electric connector having a plug connector 1 inserted/withdrawn to/from a socket connector 2. To the electric connector, a fuse 3 for shutting off overcurrent is attached.

The electric connector can be used as an electric connector for maintenance (so-called "service plug") of an electric vehicle, a hybrid vehicle, or the like. In this case, when a maintenance of an electric system is to be carried out, by withdrawing the plug connector 1 from the socket connector 2, an electric circuit can be shut off, so that electric current from a battery (not shown) can be shut off.

FIGS. 1 through 3 show an example in which the electric connector is used under a vertical posture. The electric connector is accommodated in a case K. The electric connector is fixed to an upper wall portion Ka of the case K1 with e.g. a nut N or the like.

Incidentally, in the following explanation, as shown in FIGS. 1 through 3, an inserting direction of the plug connector 1 is "a far side". A withdrawing direction of the plug connector 1 is "a near side". The fuse 3 side is "a front side" and the side opposite the fuse 3 is a "back side". And, a left side as seen from the fuse 3 side is "a left side" and the right side as seen from the fuse 3 side is "a right side", respectively.

[Plug Connector]

The plug connector 1 includes a plug contact 4 and a cap 5.

The cap 5 includes a shaft portion 6 and a pinch portion 7. To the shaft portion 6, the contact 4 is inserted and fixed. The pinch portion 7 will function as a handle at the time of insertion/withdrawal of the plug connector 1.

In an outer circumferential portion of the shaft portion 6, an O-ring 8 is provided. Under an engagement state between the plug connector 1 and the socket connector 2, this O-ring 8 provides water resistance and dust resistance functions. In the outer circumferential portion of the shaft portion 6 on farther side than the O-ring 8, a conductor portion 9 is provided. Further, in the outer circumferential portion of the shaft portion 6, between the O-ring 8 and the pinch portion 7, there are provided a pair of protruding portions 6*a*. The pair of protruding portions 6*a* are disposed at positions with a phase offset of 180 degrees, around an axis Y1 of the plug connector 1.

[Socket Connector]

The socket connector 2 includes a housing 10, a first holder 11 (corresponding to "a positive electrode portion" in the present invention), a second holder 12 (corresponding to "an attaching portion", "a negative electrode portion" in the present invention), and an attaching portion 13. In the inserting direction of the plug connector 1, the first holder 11 is disposed on the far side and the second older 12 is disposed on the near side.

[Housing]

The housing 10 comprises an engaged combination/assembly of a first split body 14 and a second split body 15. It is understood that the housing 10 need not be such split construction, but can be an integral construction. At a lateral portion of the front side of the first split body 14, there is formed a receded portion 14A which is receded toward the back side. At an end portion of the near side of the first split body 14, there is formed an approximately cylindrical mouth portion 14B. In the first split body 14, an insertion hole 14C into which the cap 5 (shaft portion 6) can be inserted is formed toward the far side from the mouth portion 14B.

In the mouth portion 14B, there are formed a pair of engaging grooves 14D engageable with the pair of protrusions 6*a* on the plug connector 1 side. In the insertion hole 14C, there are provided a pair of detection terminals 16 that can come into contact with the conductor portion 9 on the plug connector 1 side.

The pair of engaging grooves 14D are disposed with 180 degrees rotational phase displacement about the axis Y2 of the insertion hole 14C. The engaging groove 14D include a vertical groove portion 14Da extending along the axis Y2 direction of the insertion hole 14 and a side groove portion 14Db extending around the axis Y2 of the insertion hole 14C.

[First Holder]

The first holder 11 is connected to the positive electrode terminal of the battery via a primary side electric wire C1.

The first holder 11 protrudes from right side faces of the first split body 14 and the second split body 15. In the first holder 11, there are formed a first insertion hole 11*a* and a first bolt hole 11*b*.

The first insertion hole 11*a* is formed such that the plug contact 4 can be inserted therein. In the first insertion hole 11*a*, a fin contact 17 is accommodated. In the first bolt hole 11*b*, a terminal of the primary side electric wire C1 is fixed by a bolt 18.

[Second Holder]

The second holder 12 is connected to a negative terminal of the battery via the fuse 3 and a secondary side electric wire C2. The second holder 12 protrudes from a portion of the side face on the front side of the first split body 14, which portion corresponds to the receded portion 14A. In the second holder 12, there are formed a second insertion hole 12*a* an a second bolt hole 12*b*.

The second insertion hole 12*a* is formed such that the plug contact 4 can be inserted therein. In the second insertion hole 12*a*, the fin contact 17 is accommodated. In the second bolt hole 12*b*, a terminal portion 3*a* of the fuse 3 is fixed by a bolt 19. In this way, as the plug connector 4 is inserted in the second insertion hole 12*a*, the second holder 12 is electrically conducted with both the terminal portion 3*a* of the fuse 3 and the plug connector 4, the terminal portion 3*a* of the fuse 3 and the plug connector 4 are electrically conducted to each other.

[Attaching Portion]

The attaching portion 13 protrudes from a side face of the front side of the first split body 14. In the attaching portion 13, a bolt hole 13*a* is formed. In the bolt hole 13*a*, a terminal portion 3*b* of the fuse 3 and a terminal of the secondary electric wire C2 are fixed by a bolt 20.

[Fuse]

The fuse 3 includes a pair of terminal portions 3*a*, 3*b*. The fuse 3 is detachably attached to the second holder 12 and the attaching portion 13 by the bolts 19, 20, with the fuse 3 being inserted downwardly of the second holder 12 of the receded portion 14A. The fuse 3 is accommodated within the range of the housing 10 as seen from its front side or its back side. Between the fuse 3 and the first split body 14 and the second split body 12, there is formed a space S so as to suppress heat conduction between the fuse 3 side and the housing 10 side. In this way, the members included in the socket connector 2 such as the housing 10 (first split body 14), the second holder 12, the attaching portion 13, etc. function as a "fuse holder" for holding the fuse 3. In this embodiment, the fuse 3 is attached to the socket connector 2 in such a manner that a longitudinal direction of the fuse 3 extends along the longitudinal direction of the socket connector 2 and the plug connector 1 inserted into this socket connector 2.

[Method of Inserting/Withdrawing Plug Connector]

Firstly, for insertion of the plug connector 1 to the socket connector 2, the plug connector 1 is inserted into the insertion hole 14C and the protruding portions 6*a* are moved toward the far side along the vertical groove portion 14Da. Then, when the protruding portions 6*a* are positioned at the connecting portion between the vertical groove portion 14Da and a lateral groove portion 14Db, the plug connector 1 is rotated in a direction of arrow A in FIG. 3 (by 90 degrees approximately), about the axis Y2 of the insertion hole 14C.

With the above, when the protruding portions 6*a* are positioned at the end of the lateral groove portion 14Db opposite the vertical groove portion 14Da, a locked state is established and also as the conductor portion 9 comes into contact with the pair of detecting terminals 16, the locked state is detected.

As a result, electric conduction is established among the primary electric wire C1, the first holder 11 (fin contact 17), the plug contact 4, the second holder 12 (fin contact 17), the fuse 3 and the secondary electric wire C2.

Next, for withdrawal of the plug connector 1 from the socket connector 2, the plug connector 1 is rotated in a direction of arrow B in FIG. 3 (by 90 degrees approximately), about the axis Y2 of the insertion hole 14C. With this, the locked state is released and also as the conductor portion 9 moves away from the pair of detecting terminals 16, the released of locked state is detected.

And, as the protruding portions 6*a* are manually moved toward the near side along the vertical groove portion 14Da with the protruding portions 6*a* being positioned at the connecting portion between the vertical groove portion 14Da and the lateral groove portion 14Db, the plug connector 1 can be withdrawn from the socket connector 2.

[Other Embodiments]

Figure 4:
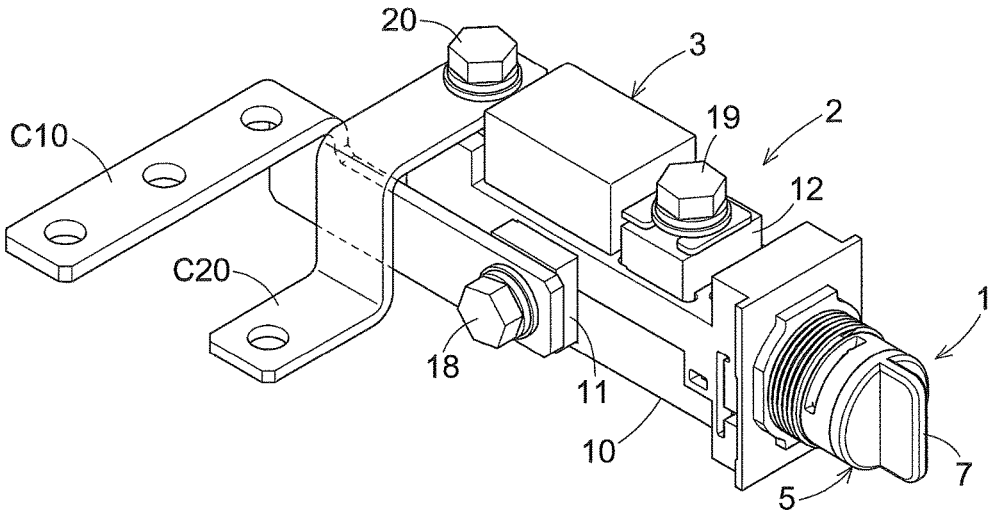
FIG. 4 is a perspective view showing an electric connector relating to a first alternative embodiment.

(1) In the foregoing embodiment, the electric connector is used under the vertical posture. Instead, the electric connector can be used under a lateral posture, as shown in FIG. 4. In the case of using the electric plug under the lateral posture as shown in FIG. 4, when the electric connector is accommodated in the case K (see FIG. 2), a primary side conductor bar C10 is fixed to the first holder 11 by the bolt 18 and a secondary conductor bar C20 is fixed to the attaching portion 13 by the bolt 20 (see FIG. 2 and FIG. 3). With this arrangement, by accessing the electric connector from the upper side, attachment/detachment operations of the conductor bars C10, C20 can be carried out easily. Incidentally, it is understood that the disposing manner of the electric connector is not limited to the vertical posture or the lateral posture.

Figure 5:
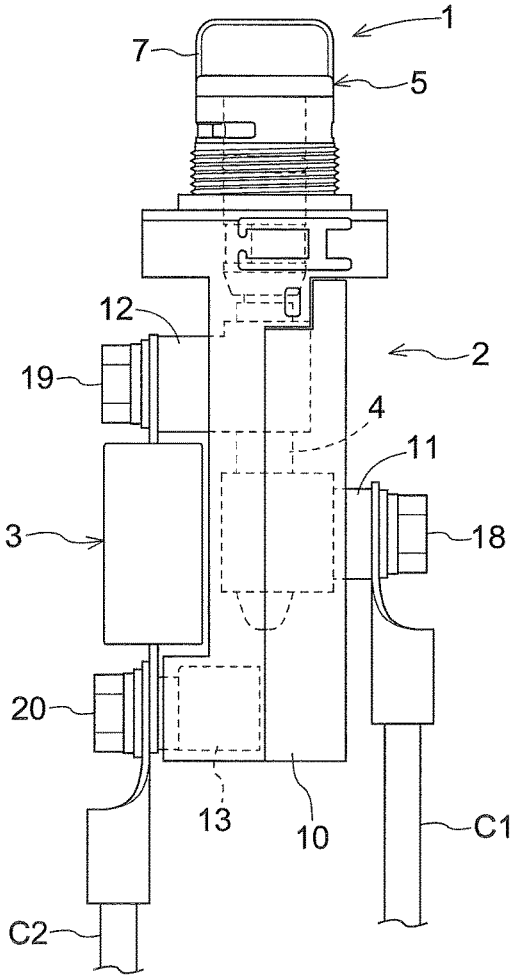
FIG. 5 is a side view showing an electric connector relating to a second alternative embodiment.

(2) In the foregoing embodiment, the first holder 11 protrudes from the right side face of the housing 10. Instead, as shown in FIG. 5, the first holder 11 can protrude from the back side face of the housing 10. Further alternatively, the first holder 11 can protrude from the left side face of the housing 10.

Figure 6:
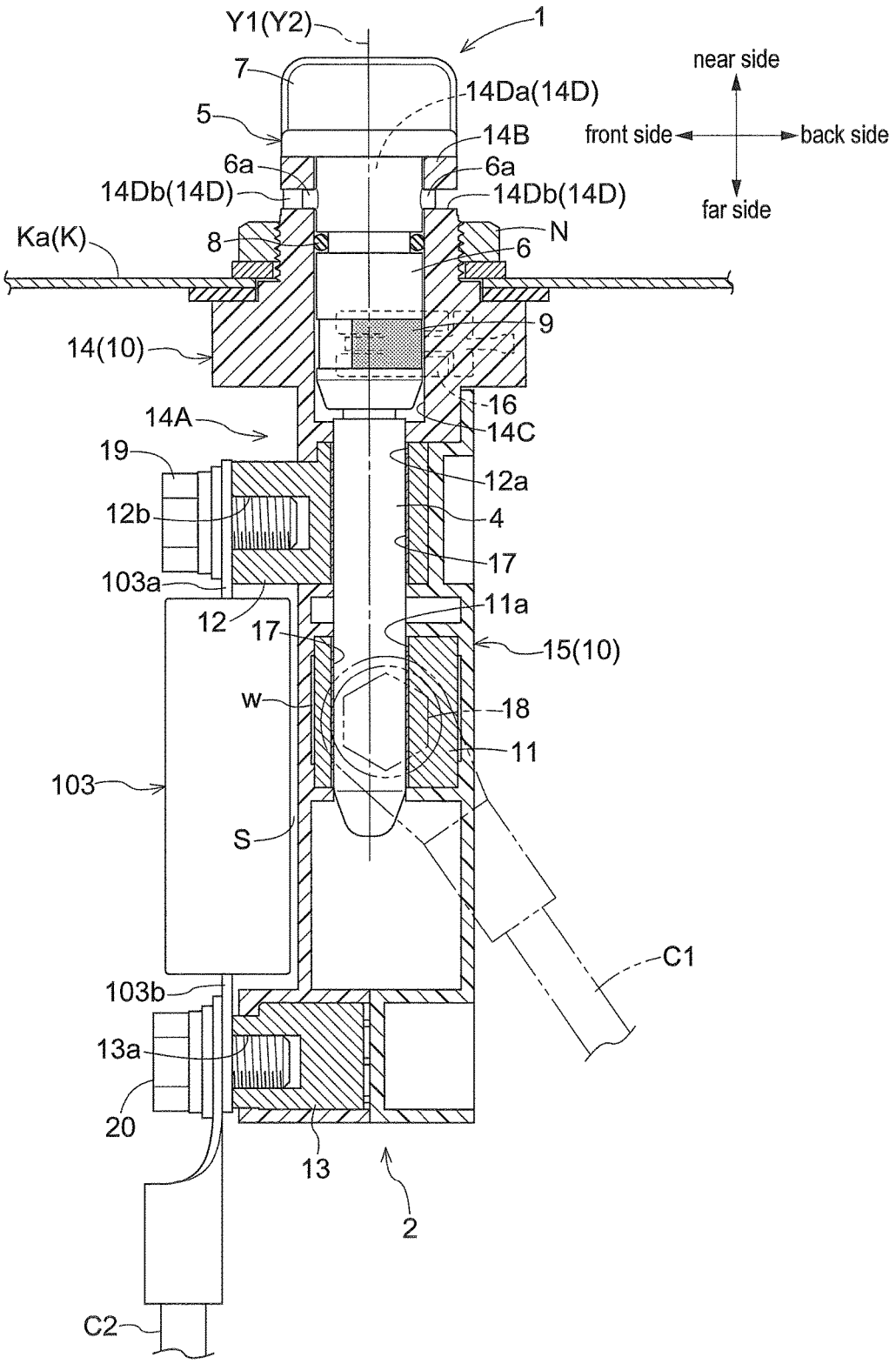
FIG. 6 is a vertical sectional view showing an electric connector relating to a third alternative embodiment.

(3) As shown in FIG. 6, a fuse 103 having a longer attaching pitch than the fuse 3 can be attached to the socket connector 2.

Figure 7:
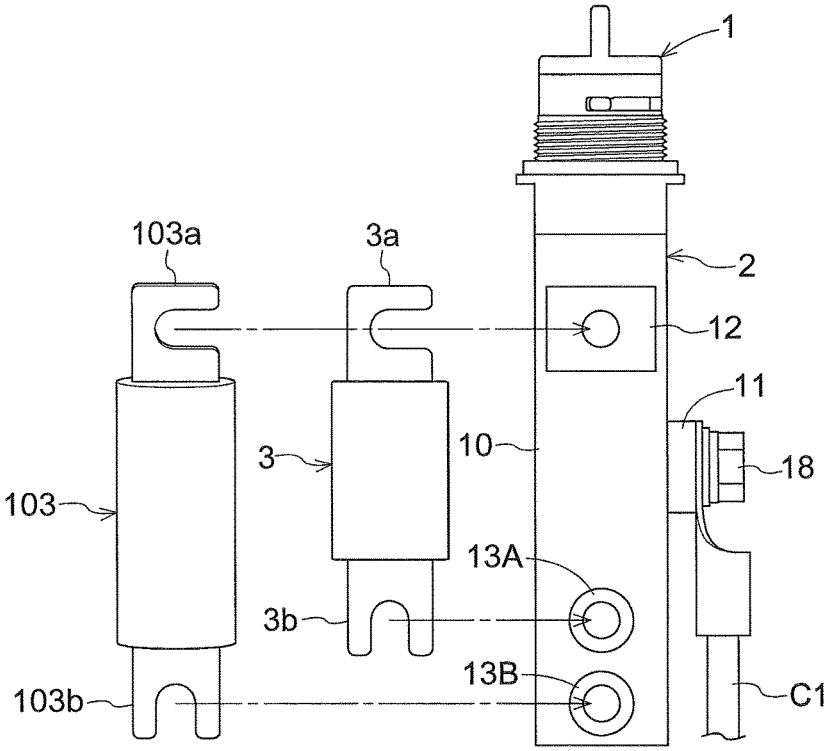
FIG. 7 is a front view showing an example of the electric connector relating to the third alternative embodiment.

For instance, as shown in FIG. 7, as the "attaching portions" relating to the present invention, the second holder 12, the attaching portion 13A and the attaching portion 13B are provided in juxtaposition with each other. With this, in the case of the fuse 3 having the short attaching pitch, the terminal portions 3*a*, 3*b* thereof can be attached respectively to the second holder 12 and the attaching portion 13A. Or, in the case of the fuse 103 having the long attaching pitch, the terminal portions 103*a*, 103*b* thereof can be attached respectively to the second holder 12 and the attaching portion 13B. Here, as fuses having different sizes and shapes, there are disclosed the rectangular short fuse 3 and the cylindrical long fuse 103. Needless to say, it is also possible to cope with fuses having a same shape, but different sizes. Incidentally, in such case, the "attaching portions" relating to the present invention can be provided four or more in number in juxtaposition with each other.

Figure 8:
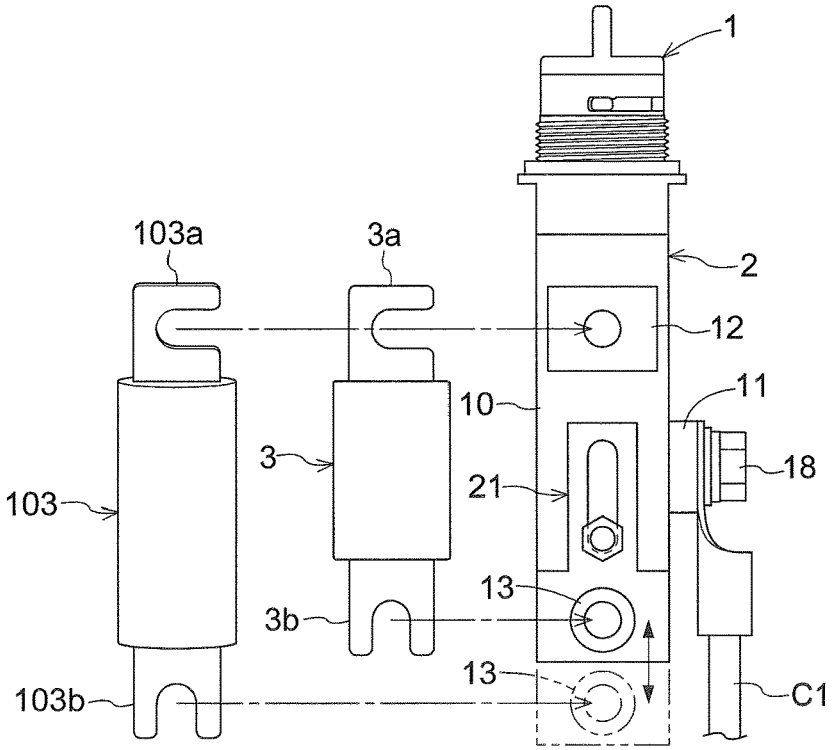
FIG. 8 is a front view showing another example of the electric connector relating to the third alternative embodiment.

Further, as shown in FIG. 8, the housing 10 can be configured to be expandable/contractible with an expansion/contraction mechanism 21, thereby to allow change of the spacing between the second holder 12 and the attaching portion 13. With this, by changing the spacing between the second holder 12 and the attaching portion 13, the fuses 3, 103 of different sizes can be attached. Namely, in the case of the fuse 30 having the short attaching pitch, the spacing between the second holder 12 and the attaching portion 13 is made shorter by the expansion/contraction mechanism 21, and the terminal portions 3*a*, 3*b* thereof will be attached respectively to the second holder 12 and the attaching portion 13. Or, in the case of the fuse 103 having the long attaching pitch, the spacing between the second holder 12 and the attaching portion 13 is made longer by the expansion/contraction mechanism 21, and the terminal portions 103*a*, 103*b* thereof will be attached respectively to the second holder 12 and the attaching portion 13. Here, as fuses having different sizes and shapes, there are disclosed the rectangular short fuse 3 and the cylindrical long fuse 103. Needless to say, it is also possible to cope with fuses having a same shape, but different sizes.

(4) In the foregoing embodiment, the fuse 3 is attached to the second holder 12. That is, the second holder 12 functions also as the "attaching portion" relating to the present invention. Instead, it is also possible to provide "an attaching portion" separately from the second holder 12.

(5) In the foregoing embodiment, the housing 10 defines the receded portion 14A. However, the receded portion 14A need not be defined therein.

Figure 9:
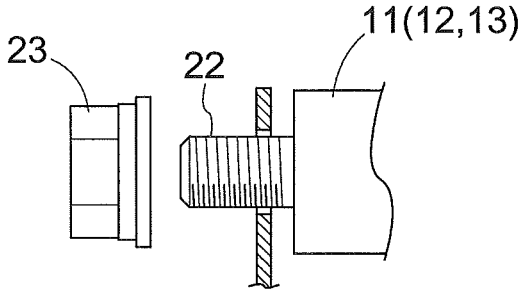
FIG. 9 is a view showing other embodiments of first holder, a second holder and an attaching portion.

(6) The first holder 11, the second holder 12 and the attaching portion 13 can be those shown in FIG. 9 also. In the first holder 11, the second holder 12 and the attaching portion 13, instead of the bolt holes (the first bolt hole 11*b*, the second bolt hole 12*b*, the bolt hole 13*a*), bolts 22 are formed. And, as nuts 23 are threaded with these bolts 22, the respective terminal portions are connected.

INDUSTRIAL APPLICATION

The present invention is applicable to an electric plug (so-called, a service plug) for maintenance of an electric vehicle, a hybrid vehicle, etc.

DESCRIPTION OF REFERENCE NUMERALS/MARKS

1: plug connector
2: socket connector
3: fuse
3*a*: terminal portion
3*b*: terminal portion
11: first holder (positive electrode portion)
12: second holder (attaching portion, negative electrode portion)
13: attaching portion
14A: receded portion

The invention claimed is:

1. An electric connector to be incorporated in an electric circuit, the electric connector comprising:
a socket connector;
a bar-like plug connector to be inserted/withdrawn to/from the socket connector; and
a fuse;
wherein when the plug connector is inserted to the socket connector, electric conduction is established in the electric circuit via the fuse; and
the fuse is attached to the socket connector; and
wherein the socket connector includes a positive electrode portion and a negative electrode portion that can be electrically conducted with the plug connector; and
the positive electrode portion is disposed on a far side in an inserting direction of the plug connector, and the negative electrode portion is disposed on a near side in the inserting direction.

2. The electric connector according to claim 1, wherein when the fuse is attached to the socket connector, a longitudinal direction of the fuse is aligned with the inserting/withdrawing direction of the plug connector.

3. The electric connector according to claim 1, wherein:
the fuse includes a pair of terminal portions to be attached to the socket connector; and
the socket connector includes a pair of attaching portions to which the pair of terminal portions are to be attached.

4. The electric connector according to claim 1, wherein:
the socket connector defines a receded portion; and
the fuse is attached to the socket connector with the fuse being placed within the receded portion.

5. The electric connector according to claim 1, wherein when the plug connector is inserted to the socket connector, the fuse is overlapped with the plug connector in a longitudinal direction of the plug connector.

6. An electric connector to be incorporated in an electric circuit, the electric connector comprising:
a socket connector;
a bar-like plug connector to be inserted/withdrawn to/from the socket connector; and
a fuse;
wherein when the plug connector is inserted to the socket connector, electric conduction is established in the electric circuit via the fuse; and
the fuse is attached to the socket connector;
wherein the fuse includes a pair of terminal portions to be attached to the socket connector; and
the socket connector includes a pair of attaching portions to which the pair of terminal portions are to be attached; and
wherein the socket connector includes a plurality of the attaching portions provided side by side and greater in number than the pair of terminal portions.

7. The electric connector according to claim 6, wherein when the fuse is attached to the socket connector, a longitudinal direction of the fuse is aligned with the inserting/withdrawing direction of the plug connector.

8. The electric connector according to claim 6, wherein:
the socket connector defines a receded portion; and
the fuse is attached to the socket connector with the fuse being placed within the receded portion.

9. The electric connector according to claim 6, wherein when the plug connector is inserted to the socket connector, the fuse is overlapped with the plug connector in a longitudinal direction of the plug connector.

10. An electric connector to be incorporated in an electric circuit, the electric connector comprising:
a socket connector;
a bar-like plug connector to be inserted/withdrawn to/from the socket connector; and
a fuse;
wherein when the plug connector is inserted to the socket connector, electric conduction is established in the electric circuit via the fuse; and
the fuse is attached to the socket connector;
wherein the fuse includes a pair of terminal portions to be attached to the socket connector; and
the socket connector includes a pair of attaching portions to which the pair of terminal portions are to be attached; and
wherein a spacing between the pair of attaching portions is changeable.

11. The electric connector according to claim 10, wherein when the fuse is attached to the socket connector, a longitudinal direction of the fuse is aligned with the inserting/withdrawing direction of the plug connector.

12. The electric connector according to claim 10, wherein:

the socket connector defines a receded portion; and the fuse is attached to the socket connector with the fuse being placed within the receded portion.

13. The electric connector according to claim 10, wherein when the plug connector is inserted to the socket connector, the fuse is overlapped with the plug connector in a longitudinal direction of the plug connector.

* * * * *